US005899149A

United States Patent [19]

Binner et al.

[11] Patent Number: 5,899,149

[45] Date of Patent: May 4, 1999

[54] INCINERATION GRATE WITH DUCTS FOR CONVEYING A HEAT TRANSMISSION MEDIUM

[75] Inventors: Siegfried Binner, Hellerup; Rasmus Stig Jensen, København, both of Denmark

[73] Assignee: Volund Ecology Systems A/S, Brondby, Denmark

[21] Appl. No.: 08/860,245

[22] PCT Filed: Dec. 28, 1995

[86] PCT No.: PCT/DK95/00522

§ 371 Date: Jun. 13, 1997

§ 102(e) Date: Jun. 13, 1997

[87] PCT Pub. No.: WO96/23174

PCT Pub. Date: Aug. 1, 1996

[30] Foreign Application Priority Data

Jan. 24, 1995 [DK] Denmark ..... 0086/95

[51] Int. Cl.[6] ..... F23K 3/08; F23H 7/08

[52] U.S. Cl. ..... 110/268; 110/281; 110/328; 126/152 B; 126/152 R; 126/163 A; 126/163 R

[58] Field of Search ..... 110/267, 268, 110/281, 307, 328; 126/152 R, 163 R, 163 A, 174, 152 B; 122/376; 414/156

[56] References Cited

U.S. PATENT DOCUMENTS

| | | | |
|---|---|---|---|
| 667,399 | 2/1901 | Maier | 122/376 |
| 2,240,590 | 5/1941 | Wallace | 122/376 |
| 2,387,383 | 10/1945 | Bennett | 122/376 |
| 4,471,704 | 9/1984 | John et al. | 110/281 |
| 4,494,469 | 1/1985 | Da Silva Pinto | 110/281 |
| 4,563,959 | 1/1986 | Fujiwara | 110/281 |
| 4,955,296 | 9/1990 | Barlow | 110/291 |
| 5,588,829 | 12/1996 | Stahl et al. | 432/77 |

FOREIGN PATENT DOCUMENTS

| | | | |
|---|---|---|---|
| 0663565 | 7/1995 | European Pat. Off. . | |
| 739654 | 1/1933 | France . | |
| 58-24720 | 2/1983 | Japan | 126/163 R |
| 2-106613 | 4/1990 | Japan | 110/307 |
| 9402666 | 4/1993 | South Africa . | |

OTHER PUBLICATIONS

Patent Abstract of Japan, vol. 14, No. 319, M–996, Abstract of JP A 2–106613 (Hitachi Zosen Corp), 18 Apr. 1990.

*Primary Examiner*—Ira S. Lazarus
*Assistant Examiner*—Ljiljana V. Ciric
*Attorney, Agent, or Firm*—Ladas & Parry

[57] ABSTRACT

A fuel-conveying incineration grate has grate beams (1) for extending in a longitudinal direction obliquely downward in the longitudinal direction. The grate beams (1) have first surfaces (4) on first sides of the grate beams (1) stepped downwardly in said direction for receiving fuel, opposite surfaces on opposite sides of the grate beams (1), and lateral surfaces (3) sealingly closely adjacent to each other across widths of the grate beams (1) substantially along full lengths of the grate beams (1) in the longitudinal direction. The grate beams (1)relatively reciprocate in the longitudinal direction for conveyting the fuel thereon. At least two longitudinally extending ducts (6, 7) are in thermal communication with the opposite sides of the grate beams (1) for a heat-transmission medium. Connecting points (12, 13) at least at one end of the grate beams (1) provide for flow of the heat-transmission medium at least one of towards and away form the ducts (6, 7). Primary-air openings (5) supply of primary air from the opposite surfaces through the grate beams (1) and spaced from the lateral surfaces (3) to the first surfaces (4) for combustion of the fuel conveyed on the first surfaces (4).

8 Claims, 3 Drawing Sheets

INCINERATION GRATE WITH DUCTS FOR CONVEYING A HEAT TRANSMISSION MEDIUM

TECHNICAL FIELD

The present invention relates to a fuel-conveying incineration grate for incinerating plants, especially for waste materials.

BACKGROUND ART

In principle, incineration grates of the kind referred to above are well-known and are normally used with two or more sections mutually overlapping, the uppermost section functioning as an infeed grate apportioning the fuel into the incinerating plant from a fuel shaft above the upper part of the grate, whilst the function of combustion per se is served by the lower section or sections, the lowermost section also discharging the solid products of combustion, such as ashes and slags, to suitable removal devices.

In a grate of this kind disclosed in U.S. Pat. No. 4,471,704 and having two sections, adjacent grate beams are reciprocated longitudinally in opposite phase, and the stepped grate surface is formed by a number of grate elements placed edge-to-edge.

In another grate of the kind referred to, disclosed in U.S. Pat. No. 4,494,469, every other grate beam is reciprocable longitudinally, while the remaining grate beams are stationary. In this grate, the grate surface is formed by a number of grate blocks composed of grate rods, each block comprising two steps of the stepped surface.

U.S. Pat. No. 2,240,590 describes a fluid cooled grate beam comprising two longitudinally extending ducts for the cooling medium provided immediately below the grate surface of each grate beam and in heat transmitting contact with said surface and the lateral surfaces of the grate beam, as well as connecting points at one end of the grate beam for the flow of cooling medium towards and away from said ducts. However, thee grate beams are not placed sealingly close to each other along the lateral surfaces. On the contrary, the grate beams are provided with primary air openings along the lateral surfaces. This will result in a tendency to move material on the grate in between the grate beams which will lead to increased wear on the lateral surfaces of the grate beams.

FR-A-739,654 describes another fluid cooled grate beam comprising flat lateral surfaces but these surfaces are placed with spaces between them.

In incinerating plants for waste material, especially the infeed grate, i.e. the uppermost grate section in the plant, is subject to extremely inhomogeneous heat influences; this is due to its function and position in the plant as well as variations in the calorific value of the waste material being fed in by this grate, because the processes taking place on the infeed grate comprise both a drying of the waste material and an initial gasification and ignition of the latter, and the manner, in which all this proceeds and hence the heating of the grate, depends to a high degree of the (net) calorific value of the waste material, i.e. especially its moisture content.

In previously known incineration grates, such as those disclosed in the above-mentioned US patent specifications, these conditions have made it difficult to achieve an effective seal between the adjacent, relatively reciprocable grate beams, more particularly between their lateral surfaces; this is caused by the temperature differences along the grate beams creating differences in their degrees of thermal expansion. An insufficient seal between adjacent lateral surfaces partly results in a greater quantity of ashes and uncombusted waste falling through the grate, this obviously being highly undesirable in consideration of the desire to achieve a sterilization and combustion of the waste material, partly an unintended distribution of the primary air, passing in an uncontrolled fashion up through the gaps between adjacent lateral surfaces.

In order to achieve a better sealing function, incineration grates of the kind referred to initially normally comprise facilities for pressing the grate beams in each section together in the lateral direction, this also making it possible to accommodate attrition on the lateral surfaces of the grate beams. This attrition, being—of course—due to the relative movements of the grate beams, will, because of their material properties, be a minimum at a relatively low temperature.

DISCLOSURE OF THE INVENTION

It is the object of the present invention to allieviate the disadvantages referred to above, partly by providing a homogeneous temperature and thermal expansion along the length of the grate beams, partly a lower temperature of the latter and, as far as infeed grates are concerned, a possibility of accelerating the drying of waste material with a high moisture content on these grates.

By circulating the heat-transmission medium in the ducts, variations in temperature along the length of the grate beam are eliminated or reduced, and it is also possible to cool or heat the grate beam depending on the temperature of the heat-transmission medium.

Even though the grate surface, as in the grate disclosed in U.S. Pat. No. 4,471,704, could consist of a number of separate grate elements, each in heat-conducting contact with the longitudinal ducts, the embodiment set forth in claim 2 is preferred, as it simplifies the construction and facilitates assembly and maintenance. In a further preferred embodiment, the heat-transmission medium flows downwardly along one side of the grate beam and upwardly along its opposite side, thus contributing further to reducing any temperature differences along the length of the grate surface.

Another embodiment is preferred if the temperature, at which the heat-transmission medium is supplied to the grate beam in the incineration grate, is lower than the average temperature of the grate surfaces. In addition to the primary effect of the circulating heat-transmission medium, viz. an equalization of temperature along the length of the grate surface, this will result in a cooling of the latter and of the lateral surfaces and hence a reduction of the attrition on the relatively moving lateral surfaces on adjacent grate beams.

Alternatively, the embodiment set forth in claim 7 may be preferred, when the supply temperature of the heat-transmission medium is higher than the average temperature of the grate surfaces. This can be advantageous in infeed grates, when waste material with a high moisture content is to be incinerated, as this material will be receiving heat from the heated grate surfaces for the evaporation of the moisture already when being delivered from the shaft. At the same time, also in this case an equalization of temperature along the length of the grate surface is achieved. This heating medium may then be a heat-transmission medium having circulated in a succeeding grate section in the incinerating plant.

In principle, the heat-transmission medium may be any suitable fluid, such as a gas, a liquid or a two-phase medium, but in practice it is preferred to use water as the heat-transmission medium, preferably alone in the liquid phase. Since this water should preferably have been treated in the same manner as feed water for boilers so as to avoid scale being deposited in the ducts and in the inlet and outlet conduits, it may advantageously after having circulated in the incineration grate be supplied to the economizer of the incinerating plant. Alternatively, it may be made to flow through a heat exchanger for cooling and supplying useful heat.

BRIEF DESCRIPTION OF THE DRAWINGS

In the following detailed portion of the present description, the invention will be explained in more detail with reference to the drawings, in which.

DESCRIPTION OF THE PREFERRED EMBODIMENT

Figure 1:
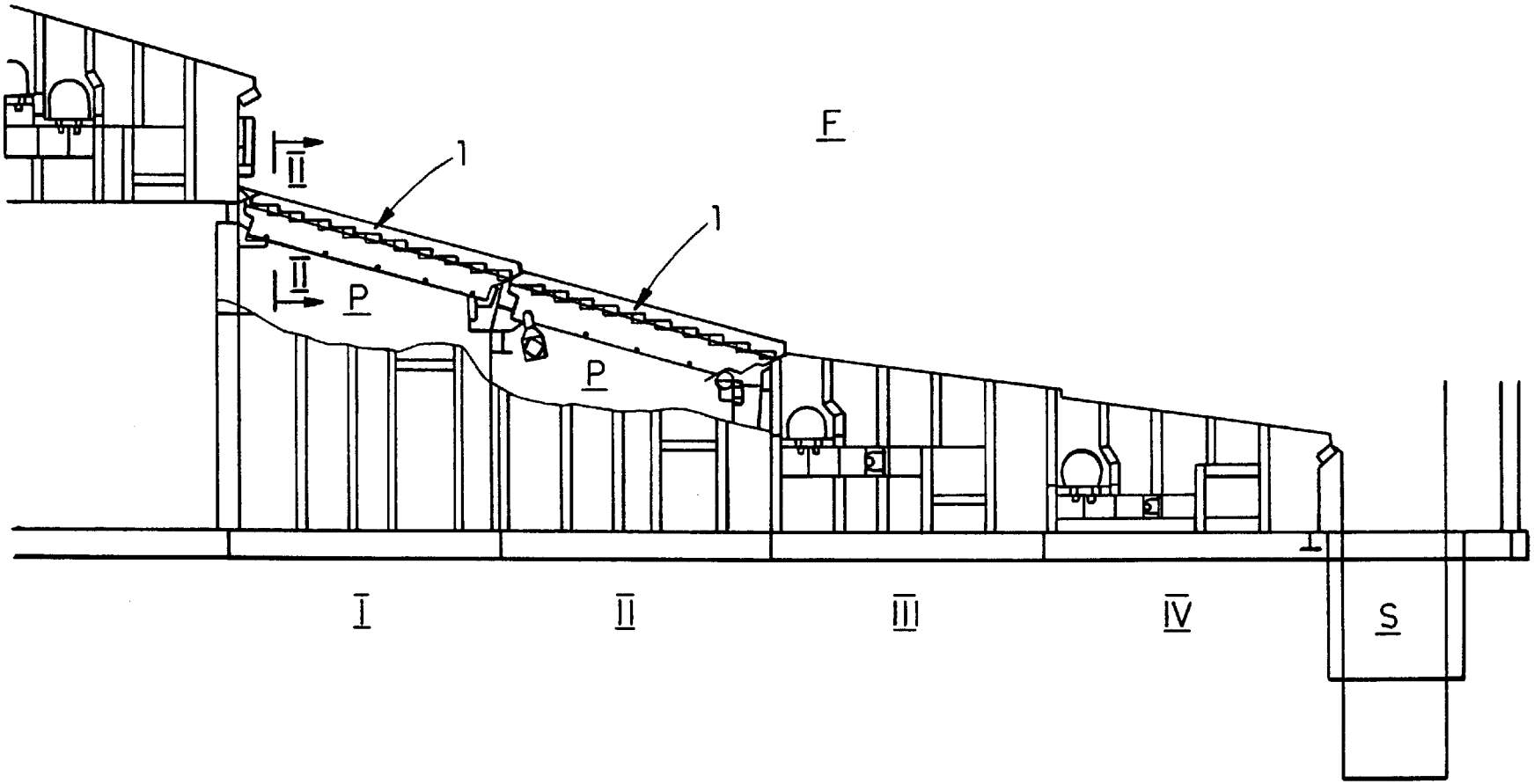
FIG. 1 is a diagrammatic side view, partly in longitudinal section along the line I—I in FIG. 2, of a combustion grate according to the invention, FIG. 2 likewise diagrammatically and at a larger scale shows a part-sectional view through a section along the line II—II in FIG. 1 of an incineration grate according to the invention.

FIG. 1 is a side view showing an incineration grate according to the invention consisting of four sections I, II, III and IV, in which the grates in each section consist of a number of grate beams generally designated 1, the side surfaces of which are closely adjacent to each other across the width of the grate. A stationary grate beam 1 is shown in section I, while a reciprocable grate beam 1 is shown in section II. As far as the present invention is concerned, these grates are of similar construction. As shown, the grate beams 1 have a stepped grate surface and extend obliquely downward in the direction of movement of the fuel, the grate beams 1 in a preceding section overlapping grate beams 1 in a succeeding section. Below the grate beams 1 in each section there is a primary-air space P, and the combustion space F of the incinerator plant extends across and along the entire incineration grate. The grate section I is an infeed grate feeding-in refuse to be incinerated from a chute or shaft (not shown) into the incinerating plant. From the grate section IV, un-combusted material, i.e. slags and ashes, fall into a slag pit S, from which it may be removed e.g. by means of a conveyor (not shown).

Figure 2:
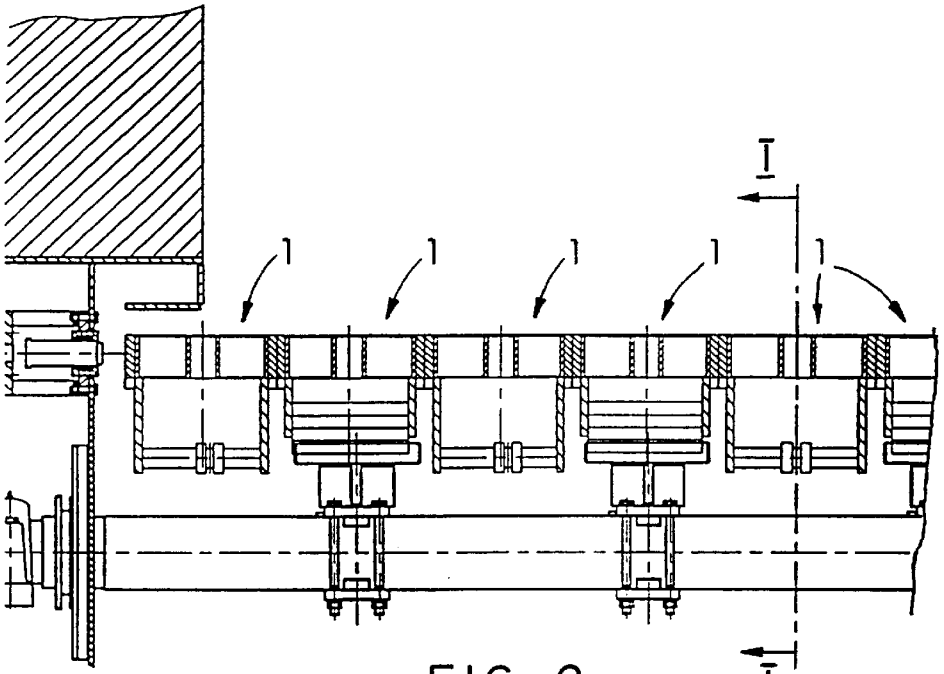

FIG. 2 is a part-sectional view at a larger scale through a grate section in an incineration grate according to the invention, in which reciprocable grate beams 1 are placed between stationary grate beams 1 as shown and described in the previously mentioned U.S. Pat. No. 4,494,469.

Figure 3:
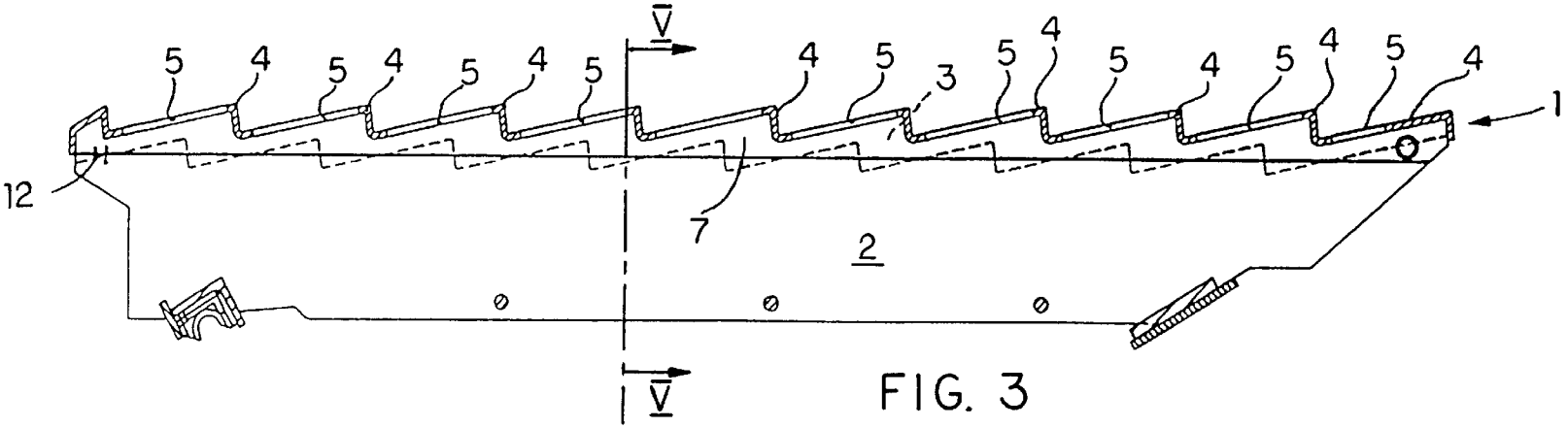
FIG. 3 is a longitudinal sectional view along the line III—III in FIG. 4 through a grate beam in an incineration grate according to the invention.
Figure 4:
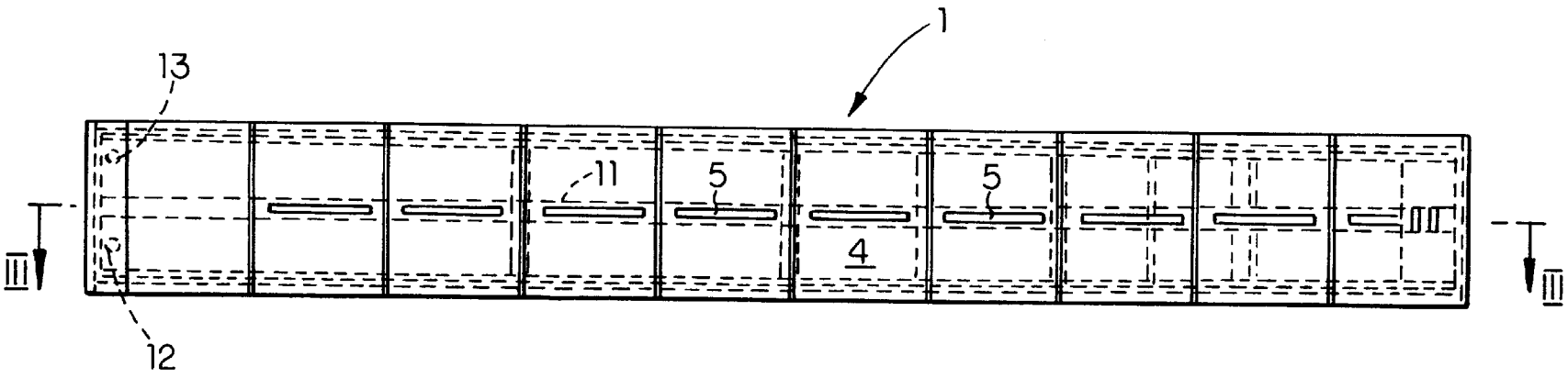
FIG. 4 is a plan view of the grate beam of FIG. 3.
Figure 5:
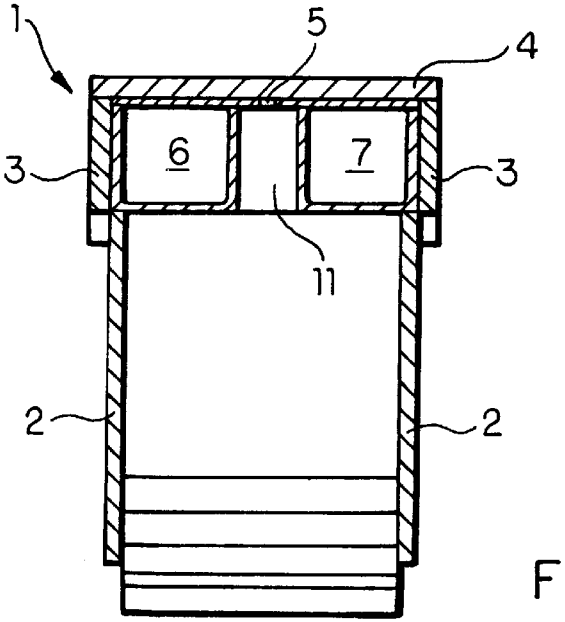
FIG. 5 is a sectional view of the grate beam shown in FIGS. 3 and 4 taken along the line V—V in FIG. 3, at an enlarged scale.

FIGS. 3, 4 and 5 show a grate beam 1 in longitudinal section, in plan view and in cross-section, respectively.

The grate beam 1 comprises two main sideboards 2, each having affixed thereto an upper sideboard 3, of which the latter may be in slidable abutment against corresponding upper sideboards on adjacent grate beams in the grate. The top edges of the upper sideboards 3 are stepped, and an equally stepped, unitary grate plate 4 is secured to these top edges. A primary-air opening 5 extending in the longitudinal direction of the grate plate 4 is formed in the centre of each of the latter's steps. The primary-air openings may be omitted in some of these steps, thus in the uppermost steps in infeed grates, i.e. the steps to the left in FIGS. 3 and 4, on which no combustion is taking place. Two ducts 6 and 7 extend below, along the full length of and in heat-transferring contact with the grate plate 4 and the upper sideboards 3, the top sides of these ducts thus being stepped in the same manner as the grate plate 4. At the lower end of the grate beam 1, i.e. in FIGS. 3 and 4 the right-hand end, the ducts 6 and 7 are connected to each other through a tubular duct 10, the ducts 6 and 7 being separated by an interspace 11 extending below the primary-air openings 5 in the grate plate 4 and thus connecting the primary-air openings 5 with the primary-air space P below the incineration grate and the grate beam 1. At the upper end of the grate beam 1, i.e. the left-hand end in FIGS. 3 and 4, each of the ducts 6 and 7 have connecting points 13 and 12, respectively—in FIGS. 3 and 4 shown purely diagrammatically—for supplying a heat-transmission medium to the ducts 6 and 7 and removing said medium from them.

Now, if water at room temperature is made to flow through the connecting point 13 and the duct 6, via the tubular duct 10 to the duct 7 and upwardly through the latter towards the connecting point 12, a general cooling of the lower, heated part (the right-hand part in FIGS. 3 and 4) of the grate beam 1, more particularly of the latter's grate plate 4 and upper sideboards 3, takes place. This causes a thermal contraction of this part of the grate beam 1 to take place, this especially causing a reduction of its width between the outside surfaces of the upper sideboards 3. The water thus having been heated will, when flowing upwardly through the duct 7, cause the upper part of the adjacent upper sideboards 3 and the overlying part on the grate plate 4 to be heated, thus causing a thermal expansion of the grate beam 1 in this region, especially an increase of its width between the outside surfaces of the upper sideboards 3. Depending on the flow velocity of the water, this makes it possible to achieve an equalization of the width of the grate beam between the outside surfaces of the upper sideboards 3 along the length of the beam, thus making it possible to overcome or at least reduce the disadvantage of lack of sealing between adjacent grate beams 1.

At the same time, a cooling of the hottest parts of the upper sideboards 3 and hence a reduced wear on the latter is achieved.

Further, when burning waste with an especially high net calorific value, and when not only drying, initial gasification and ignition of the waste material occur on the infeed grate, but also an undesired combustion of this waste, a cooling of the grate beams 1 of the infeed grate will be able to cause cooling of the waste material on the latter, thus delaying these processes to such an extent that the undesired combustion on the infeed grate is avoided.

If, instead of water at room temperature, heated water is made to flow through the ducts 6 and 7 in the grate beams 1 of the infeed grate, e.g. water having been heated by circulating through grate beams 1 in a succeeding grate section in the incinerating plant, it is also in this manner possible to achieve the desired equalization of the outside width of each grate beam 1 along its length and hence the desired sealing between adjacent grate beams 1 in the infeed grate. When burning very humid waste with a low net calorific value, the heated grate beams 1 will then also be able to accelerate the evaporation of moisture from the waste material, thus ensuring a normal process of drying, gasification and ignition of the waste material on the infeed grate.

LIST OF PARTS

F combustion space

P primary-air space

S slag pit

I grate section/infeed grate

II grate section

III grate section

IV grate section

1 grate beam

2 main sideboard

3 upper sideboard

4 grate plate

5 primary-air opening

6 duct

7 duct

10 tubular duct

11 interspace

12 connecting point

13 connecting point

We claim:

1. A fuel-conveying incineration grate for an incinerating plant, the grate comprising:

grate beams (1) for extending in a longitudinal direction obliquely downward in the longitudinal direction, the grate beams (1) having first surfaces (4) on first sides of the grate beams (1) stepped downwardly in said direction for receiving fuel, opposite surfaces on opposite sides of the grate beams (1), and lateral surfaces (3) sealingly closely adjacent to each other across widths of the grate beams (1) substantially along full lengths of the grate beams (1) in the longitudinal direction;

means for relatively reciprocating adjacent ones of the grate beams (1) in the longitudinal direction for conveying the fuel thereon;

at least two longitudinally extending ducts (6, 7) in thermal communication with the opposite sides of the grate beams (1) for a heat-transmission medium;

connecting points (12, 13) at least at one end of the grate beams (1) for flow of the heat-transmission medium at least one of towards and away form the ducts (6, 7); and primary-air openings (5) for supply of primary air from the opposite surfaces through the grate beams (1) and spaced from the lateral surfaces (3) to the first surfaces (4) for combustion of the fuel conveyed on the first surfaces (4).

2. The fuel-conveying incineration grate according to claim 1, wherein the first surfaces (4) of of the grate beams (1) extend substantially along the full lengths of the grate beams (1).

3. The fuel-conveying incineration grate according to claim 1, wherein the ducts (6, 7) extend at least substantially along the full lengths of the grate beams (1).

4. The fuel-conveying incineration grate according to claim 3, wherein the primary-air openings (5) extend longitudinally in a middle of at least step of the stepped first surfaces (4).

5. The fuel-conveying incineration grate according to claim 3, wherein the connecting points (12, 13) are at one end of the grate beams (1), opposite ends of the ducts (6, 7) being interconnected.

6. The fuel-conveying incineration grate according to claim 1, wherein the flow of the heat-transmission medium carries heat out of the ducts.

7. Use of an incineration grate according to claim 1, characterized in that the heat-transmission medium is used as a heating medium.

8. Use of an incineraton grate according to claim 1, characterized in that the used heat-transmission medium is water.

* * * * *